United States Patent [19]

Guibert et al.

[11] Patent Number: 4,679,981

[45] Date of Patent: Jul. 14, 1987

[54] TURBINE RING FOR A GAS TURBINE ENGINE

[75] Inventors: Alain J. E. Guibert, Savigny le Temple; Roland R. Mestre, Melun; Remy P. C. Ritt, Vaux Le Penil, all of France

[73] Assignee: S.N.E.C.M.A., Paris, France

[21] Appl. No.: 798,318

[22] Filed: Nov. 15, 1985

[30] Foreign Application Priority Data

Nov. 22, 1984 [FR] France ..... 84 17775

[51] Int. Cl.[4] ..... F04D 29/58

[52] U.S. Cl. ..... 415/116; 415/171

[58] Field of Search ..... 415/134, 136, 137, 138, 415/116, 175, 170, 174, 197, 115, 171

[56] References Cited

U.S. PATENT DOCUMENTS

| | | | |
|---|---|---|---|
| 3,583,824 | 6/1971 | Smuland | 415/134 |
| 4,087,199 | 5/1978 | Hemsworth | 415/197 |
| 4,329,113 | 5/1982 | Ayache et al. | 415/116 |
| 4,379,677 | 4/1983 | Hallinger et al. | 415/138 |
| 4,497,610 | 2/1985 | Richardson et al. | 415/116 |
| 4,551,064 | 11/1985 | Pask | 415/116 |

FOREIGN PATENT DOCUMENTS

| | | | |
|---|---|---|---|
| 2416345 | 8/1979 | France | 415/116 |
| 1484288 | 9/1977 | United Kingdom | 415/116 |

*Primary Examiner*—Robert E. Garrett
*Assistant Examiner*—John Kwon
*Attorney, Agent, or Firm*—Oblon, Fisher, Spivak, McClelland & Maier

[57] ABSTRACT

A turbine ring has an annular metallic carrier which is mounted within the inside of the turbine casing and within the carrier there is provided a ceramic abradable ring. A cooling air circuit is provided to regulate the temperature of only the annular carrier such that the latter always exerts a centripetal compression force on the ring under all operational conditions of the gas turbine to clamp the abradable ring.

7 Claims, 2 Drawing Figures

TURBINE RING FOR A GAS TURBINE ENGINE

BACKGROUND OF THE INVENTION

1. Field of the Invention

The present invention relates to a turbine ring for a gas turbine.

2. Summary of the Prior Art

Nos. FR-A-2 540 937, FR-A-2 540 938, FR-A-2 540 939 and FR-A-2 371 575, all described turbine rings for gas turbines, each such ring including an annular carrier secured to the inside of the turbine casing, and a ring, which is at least partially formed of a ceramic, abradable material, and which is secured to the inside of the said annular carrier. In most of these constructions, the annular carrier is of a metallic material and, as a result of the substantial difference existing between the respective coefficients of expansion of the metallic materials and of the ceramic materials, the ring of ceramic material must be built up from segments which are independent of one another, and interconnected by their respective ends in such a way as to enable the radius of the ring to follow variations in the radius of the annular carrier, as a function of the differential temperatures which the latter assumes for various operational ratings of the turbine, thus avoiding the ring of ceramic material being subjected to stresses which are incompatible with the mechanical strength of the material on which it is made.

No. FR-A-2 559 834 describes, in the preamble, numerous disadvantages associated with the use of a ring of ceramic material, built up from juxtapose multiple segments. Furthermore, it is indicated that the disadvantages may be at least partially overcome by constructing the annular carrier also of a ceramic material, and manufacturing the abradable ring in a single piece. In one preferred embodiment of the turbine ring described in this French patent application, the dimensioning is, furthermore, such that the annular carrier exerts, when cold, on the abradable ring, a predetermined precompression force in such a way as to cancel out or even invert the forces at the normal operational temperature of the turbine. In this previously proposed technique there is thus avoided the necessity of providing for metallic interconnections between two parts built up on the one hand from a metallic material and on the other of a ceramic material. In practice the interconnections between the abradable ring and its annular carrier are provided, in accordance with this prior proposal, by radial screw threaded members, screwed into inserts locked into the abradable rings. The relative complexity of the structure is compensated by the facility which it for disassembly of the ring, for example for the purpose of replacing its abradable part.

In several of the prior patent applications, which have been referred to hereinbefore, means are provided for controlling the temperature of the component parts of the turbine ring, such means comprising for example means to provide a flow of cooling air derived from the compressor of the turbine plant. Such cooling means are generally arranged so that they act indiscriminantly on the two main components of the turbine ring, namely the annular carrier and the element or elements of abradable ceramic material. As a result, the temperature gradient between the inner faces and the outer faces of the abradable ring, for example, is very substantial and, in itself, gives rise to stresses which can reduce its useful life.

SUMMARY OF THE INVENTION

According to the present invention there is provided a turbine ring for a gas turbine having a turbine casing, an annular metallic carrier mounted within the casing, a one-piece ring of ceramic abradable material mounted within the annular carrier and having a size relationship such that a precompression force is applied by the carrier to the ceramic ring and the compression force is maintained under all operational ratings of the gas turbine plant, means for supplying cooling fluid to the annular carrier, and means for regulating the supply of cooling fluid to the annular carrier and thereby control only the temperature of the annular carrier.

As only the annular carrier of the turbine ring in accordance with the present invention is cooled, the temperature gradient between the inner and outer surfaces of the abradable ring is relatively small, which avoids the generation therein of stresses liable to reduce its useful life. Furthermore, the temperature gradient in the radial direction within the annular carrier is very substantial, but, as this carrier is of metal, it readily accommodates the thermal stresses which result. The temperature control means of the annular carrier can readily be regulated, in accordance with the present invention, for example by automatically regulating the cooling air mass flow to the annular carrier so that under all operational phases of the turbine, that is to say both at cruising phases as well as various transitory phases, the abradable ceramic material ring will always be subjected to centripetal compression generated by the annular carrier, which thus serves the role of a constraint. Under certain operational conditions of the turbine this avoids the ceramic material of the ring becoming the site of tensile stresses, liable to interfere with its cohesion and, in any event to reduce its useful life. It is known, in practice, that for the most part ceramic materials have poor strength in traction or tension. The specific structure of the turbine ring in accordance with the present invention offers furthermore the additional advantage that: the internal diameter of the abradable ring can be adjusted with the aid of temperature control means on the annular carrier, that is to say, for example, by causing the cooling air mass flow to vary in dependence upon the adjustment of the spacing between the ring and the tips of the corresponding blades of the rotor of the turbine as a consequence. This advantageous possibility, which results from the structure of the turbine ring in accordance with the present invention, is particularly advantageous, because it allows readaptation of the clearance referred to at any given instantaneous state of operation of the turbine. In practice the clearance referred to should preferably provide for different values at different operational phases, whether permanent or transitory during operation of the turbine.

British patent application published under No. 2 047 354 describes a turbine ring of which the inner diameter, and as a result its clearance from the tips of the corresponding rotor blades, can be adjusted by means for regulating the temperature of the turbine ring, having an internal flow and possibly also an external flow of cooling air. This turbine ring, as previously proposed requires, to achieve this aim, a very complex internal structure. The internal flow arrangement for the air is, therein, effected with the aid of radial ducts, which traverse the casing of the turbine, and on the internal ends of which the ring assembly is mounted so as to be able to slide radially when the said ring expands or contracts. Because of its complexity, this previously proposed structure differs substantially from the turbine ring in accordance with the present invention.

In one preferred embodiment of the turbine ring in accordance with the present invention, the centripetal compression is transmitted by the annular carrier of the abradable ring, through the intermediary of members having low thermal conductivity, for example of limited cross-section. These members may comprise, for example, radial projections from one of the surfaces facing one another, of the annular carrier and of the abradable ring. Such an arrangement clearly results in reduction in the thermal gradient between the inner and outer surfaces of the abradable ring, thus substantially reducing heat exchange between the mutually facing outer and inner surfaces of the abradable ring and annular carrier respectively. Once again this reduces the stresses of thermal origin within the interior of the abradable ring.

According to another, optional, but nevertheless advantageous characteristic, the annular carrier of turbine ring in accordance with the present invention can be engaged with a slight interference fit between two radial flanges, secured to the inner wall of the casing of the turbine, and means, comprising for example pins cooperating with slide members, are provided in order to axially and rotationally immobilize, and in order to guide radially the annular carrier while maintaining centering when the annular carrier expands or contracts. Such an arrangement is particularly advantageous since it permits substantial variations in the inner diameter of the abradable ring,and the clearance with respect to the tips of the rotor blades, for example by providing for variations in the cooling air mass flow, and, without the geometrical location of the ring, with respect to the corresponding rotor ceasing to be defined with the necessary precision to maintain the coaxial relationship of the ring and the rotor.

DESCRIPTION OF THE PREFERRED EMBODIMENTS

Figure 1:
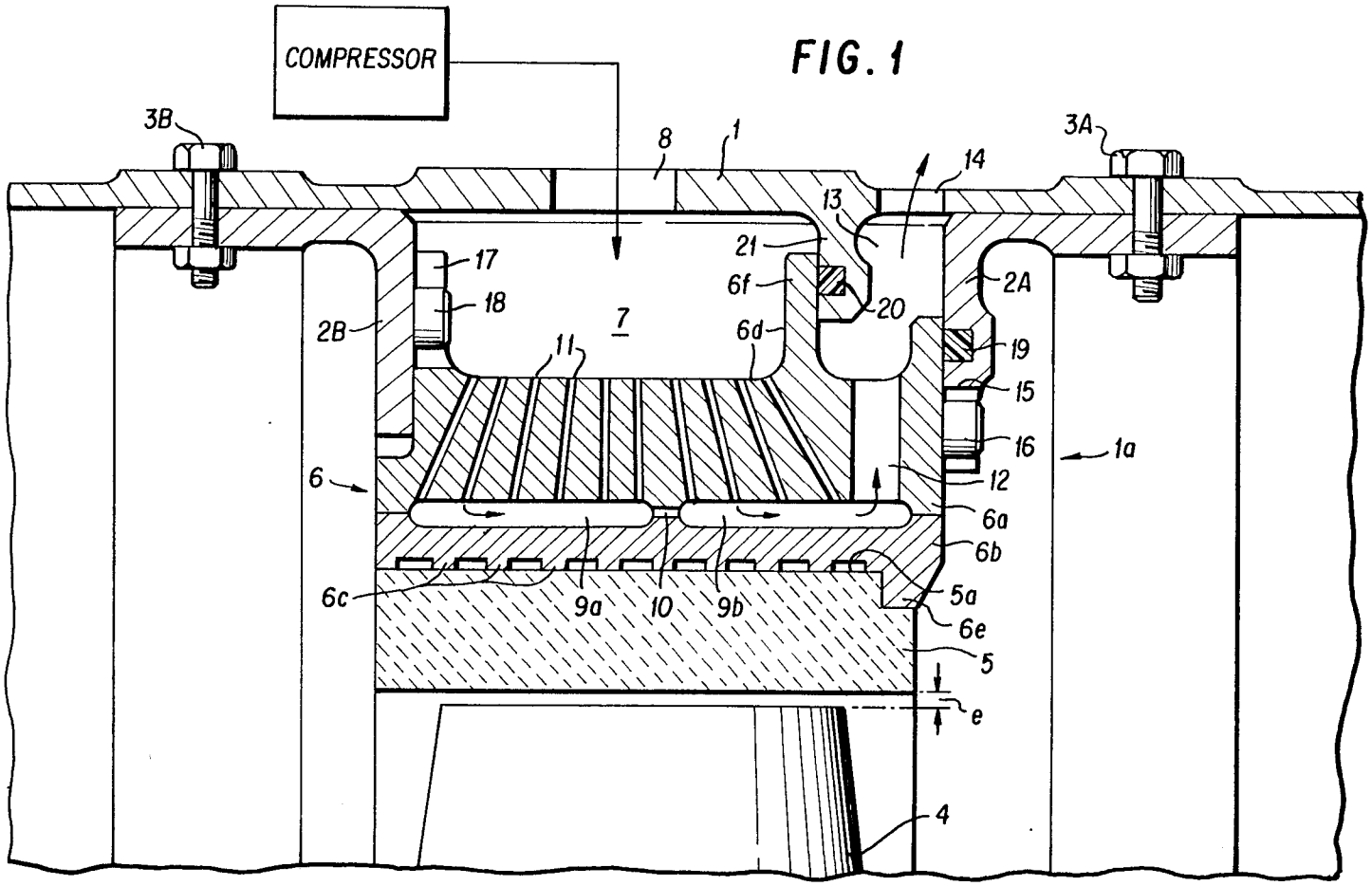
FIG. 1 is a fragmentary view, in section on a half axial plane of the casing of a turbine, provided with a turbine ring in accordance with the present invention.

Referring now to FIG. 1, part of the casing 1 of a gas turbine includes two radial flanges 2A and 2B which are secured to the inner wall of the casing 1 by an appropriate means, for example by nuts and bolts 3A and 3B. A turbine ring designated by the general reference 1*a* is mounted between the flanges 2A and 2B. The tip of one rotor blade of the gas turbine under consideration is designated by 4, the other parts of the rotor being omitted as they are not relevant to the present invention. The rotor is surrounded by a one-piece ring 5, which is made of a ceramic, abradable, material, which must be so selected that it will resist temperature of at least 1000° C. and have coefficents of thermal conduction and expansion, less than those of the materials forming the other parts of the turbine.

Ther ceramic material of the ring 5 must also have a good resistance to erosion under the action of high temperature gases and also be abradable. Different types of ceramic abradable material are known which satisfy these requirements, and they can be used to form the ring 5.

In this embodiment, the outer, cylindrical, surface of the abradable ring 5, is smooth, and it is in direct contact with the inner surface of an annular metallic carrier 6, which may be formed for example from two annular parts 6*a* and 6*b*. In this embodiment, the inner part 6*b*, of the annular carrier 6 is in contact with the outer cylindrical surface 5*a* of the abradable ring 5 not by a cylindrical surface, but through pegs or other projections 6*c*, whose total cross sections, perpendicular to the axial plane of the Figure, is substantially less than the area of the outer surface 5*a* of the abradable ring 5. These pegs 6*c* which form radial projections on the inner surface of the metallic carrier 6, directed towards the outer surface 5*a* of the abradable ring 5, serve as support elements with small surface contact area, thus reducing the heat transfer between the component parts 5 and 6.

According to the present invention, the annular carrier 6 has, when cold, an inner diameter slightly less than the outer diameter of the abradable ring 5, and it must be preheated in order for it to be engaged within the abradable ring 5 which remains cold.

On cooling down the annular carrier 6 exerts a centripetal compressive force on the abradable ring 5 in the manner of a clamping device. The assembly is initially dimensioned taking into account temperatures to which the parts 5 and 6 are subjected at various operational phases, either permanent or transitory during operation of the gas turbine so that the clamping of the ring 5 by the annular carrier 6 to effect centripetal compression exists at all operational phases of the gas turbine. This avoids any risk of the ceramic material forming the abradable ring 5 becoming subject, under certain operation conditions of the turbine plant, to tensile stresses liable to affect the cohesion of the ceramic material and to reduce the useful life of the ring.

In accordance with the present invention, the only means for regulating the temperature of the annular metallic carrier 6 are provided more particularly in the embodiment under consideration in the form of a cooling air circuit as follows: an annular distribution chamber 7 is defined by the turbine casing 1 and by walls of an annular duct 6*d*, provided in the annular carrier 6 so as to open out at its outer surface. The cooling air bled from the compressor (not shown) of the turbine plant by known means, likewise not shown, enters the annular distribution chamber 7 through an opening 8 of the turbine casing 1.

Substantially parallel to the inner surface of the annular carrier 6 there are provided in the interior thereof cavities 9*a*,9*b* which intercommunicate through a duct 10, and which are supplied with cooling air derived from the distribution chamber 7, through ducts 11 of closed section formed in the annular carrier 6. In order to facilitate the manufacture of the latter it may be constructed, as already indicated, by two annular members 6*a* and 6*b* of which the cylindrical contacting surface extend past the cavities 9*a* and 9*b* and the duct 10. The innermost part 6*b*, provided with the pegs 6*c* together with at least one lug 6*e*, thus comes into engagement at a recess of a shape complementary to one of the edges of the abradable ring 5 in order to fix the two parts 5 and 6 with respect to one another.

The cooling air, which has traversed the cavities 9*a* and 9*b*, exhausts subsequently through exhaust ducts 12, into an annular collecting chamber 13 and an opening 14 in the casing 1, so as to be returend to the secondary flow of the gas turbine plant or used again for other cooling purposes (for example the inlet guide nozzle array of the low pressure turbine).

The annular carrier 6 is clamped with a slight interference fit between the two radial flanges 2A and 2B, which are secured to the inner wall of casing 1 of the turbine. In the embodiment illustrated, at least three slots 15 are machined in the flange 2A in order to guide radially one pin 16 each, secured to the corresponding front surface of the annular carrier 6. Similarly at least three slots 17 are machined in the left-hand part of the annular carrier 6 and pins 18, of corresponding diameter are secured to the corresponding surfce of the flange 2B and are engaged in respective slots. Owing to these arrangements, the displacement of the annular carrier 6 and of the abradable ring 5, with respect to the flanges 2A and 2B, which result from expansions or contractions of the parts 5 and 6, are radially guided with the cooperation of pins such as 16 and 18, with the slots such as 15 and 17, so as to maintain the rings 5 and 6 precisely coaxial to the corresponding rotor of the turbine. This is essential so as to maintain the clearance e between the inner, cylindrical surface of the abradable ring 5, on the one hand and the cylindrical surface swept by the blade tips 4 of the turbine rotor on the other hand, having the same width appropriate, at all points both in the axial direction and in the peripheral direction. The cooperation of the pins such as 16 and 18 with the slots such as 15 and 17, ensures, furthermore, immobilization rotationally of the rings 5 and 6 with respect to the casing 1, whilst the radial flanges 2A and 2B provide for immobilization in the axial direction.

An annular seal 19 is mounted in an annular recess of the flange 2A, in order to provide for sealing between the latter and the corresponding face of the annular carrier 6, despite relative displacements of these two members in the radial direction. A further annular seal 20, provides sealing between the distribution chamber for the cooling air 7 and the collecting chamber 13. The seal 20 is located in an annular groove of a radial projection 21, machined in the inner face of the casing 1, opposite to the radial projection 6*f*, which forms one of the lateral walls 6*d* of the cooling air duct.

During operation of the turbine, the inner surface of the abradable ring 5, directed towards the tips of the blades 4 of the rotor, is brought, for example, to a temperature of the order of 1200° C. As no cooling means for the abradable ring 5 are provided in accordance with the invention, its outer surface 5*a* then rises to a temperature of the order of 900° C., although the abradable ring 5 is only subject to a relatively small thermal gradient which will not give rise therein to any thermal stresses sufficient to adversely affect the cohesion of the ceramic material of which it is made. In contrast, there is a very substantial thermal gradient between the pegs 6*c* of the annular carrier 6 and the casing 1, but the thermal stresses to which the gradient can give rise are readily accommodated by the metallic material forming the annular carrier 6, the more so because the mass of the latter is cooled at its core by air which traverses the ducts 10 and 11 and the cavities 9*a* and 9*b*. The latter can moreover be so arranged as to form a kind of thermal screen between the part 6*b* of the annular carrier 6, which is further inwardly, and thus hotter, and the outer part 6*a*.

By producing variations in the mass flow of the cooling air which is conducted through the opening of the casing 1, it is possible to regulate the temperature of the annular carrier 6 without changing that of the abradable ring 5. It is thus also possible to vary the inner diameter of the annular carrier 6 and, as a result, the centripetal compression of the abradable ring 5 and thus its inner diameter and the width of the clearance e, in order to adapt to various operational phases of the turbine, as has been referred to hereinbefore.

In order to produce a substantial amplitude in possible variations in the inner diameter of the annular ring 6, and as a result the clearance e, it is opportune to manufacture the annular carrier 6 of a metallic material having a coefficient of expansion lying between 10 and $20.10^{-6}°C^{-1}$. In contrast, the ring 5 can be made of a ceramic material having a relatively small coefficient of expansion and/or time response to thermal transitories, substantially in excess of that of the metallic material constituting the annular carrier 6.

The present invention is not limited to the embodiment hereinbefore described. It encompasses all modifications of which only a few will be referred to hereinafter by way of example. The means of axially guiding the radial displacement of the annular carrier 6, resulting from expansions and contractions are capable of various structures, different from those hereinbefore described. The arrangement of the cooling circuit of the annular carrier provides several options. The number and arrangement of the cavities such as 9*a* and 9*b* can be varied. They are, however, preferably provided so as to constitute one or more thermal barriers in the regions of the inner surface of the annular carrier 6. The pegs of other projections 6*c* may be placed in contact with corresponding pegs, provided on the outer surface of the abradable ring 5. Other means can be used for reducing the thermal conductivity between the parts 5 and 6, for example the interposition of thermal insulators. The pegs such as 6*c* may themselves receive a thermal outer barrier, for example in the form of a coating of magnesium zirconate.

Figure 2:
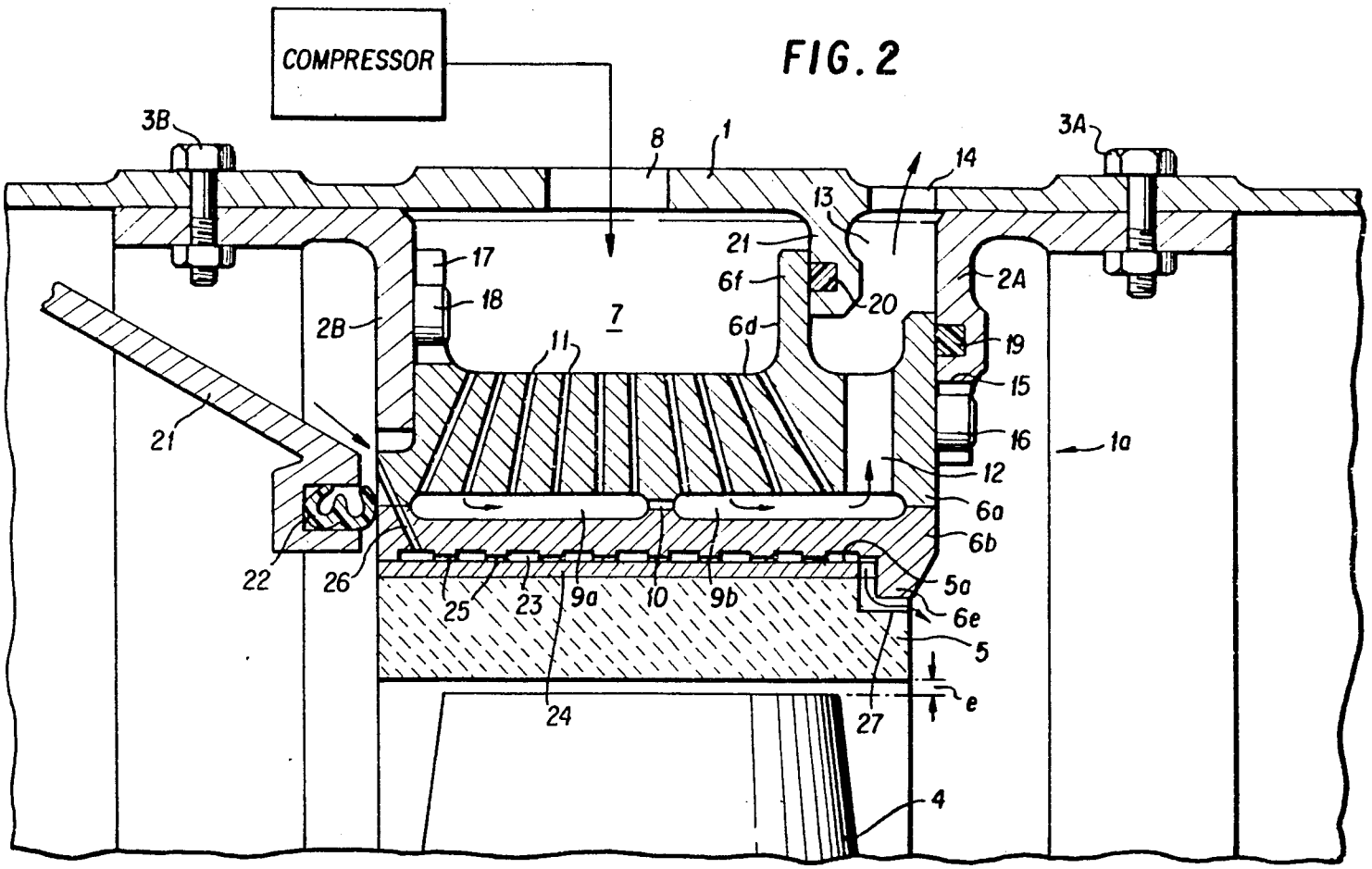
FIG. 2 is a view similar to that of FIG. 1 in which the turbine ring incorporates a modification.

In accordance with another modification, cooling is provided on the metallic/ceramic interface in the case where its temperature exceeds the admissible limit for the material of the clamping device. One construction of this arrangement is illustrated in FIG. 2 and here the effect of notching of the ceramic by the pegs is avoided while nevertheless providing an effective thermal barrier. A conical wall 25 of which the sealing with the ring is provided by means of a seal 22 is disposed upstream of the said ring 1*a* and thus provides a duct for the cooling air. The radially inner part of the interior part 6*b* of the annular carrier 6 includes a series of circular grooves 23 forming annular cavities disposed axially and closed at their inner diameter by a thin ring 24 secured for example by brazing on the annular carrier 6. The grooves 23 communicate through axial recesses 25. The annular carrier 6 includes on its lateral upstream face a series of apertures 26 through which cooling air is led into the groove circuit 23. At the interface between the annular carrier 6 and the rings 5, passage 27 is provided at the downstream side for the removal of air which is circulated in the grooves 23.

Control means for the temperature of the annular metallic carrier 6, instead of comprising a cooling air circuit, may for example comprise a liquid cooling circuit, this liquid being subjected to a change of state in the cooling zone or alternatively no change of state may take place.

What is claimed is:

1. A turbine ring for a gas turbine comprising:

a turbine casing;

an annular metallic carrier mounted within the casing;

a one-piece ring of ceramic abradable material mounted within the annular carrier, said carrier having means for reducing heat transfer from said ceramic ring to said carrier and means for applying a compression force to the ceramic ring under all operational phases of the gas turbine;

means connected to a bleed of a compressor of said gas turbine for supplying cooling fluid to the annular carrier; and means for regulating the supply of cooling fluid to the annular carrier, whereby only the temperature of the annular carries is controlled, wherein said means for reducing heat transfer includes means for providing a small cross-section of contact between said ceramic ring and said carrier, said means for providing a small area of contact comprising a plurality of projections which extend radially between juxtaposed surfaces of the ceramic ring and the annular carrier, and wherein said means for suppying cooling fluid to the annular carrier lacks means to cool directly other parts of the turbine ring and comprises:

(a) fluid distribution chamber means defined by the turbine casing and an annular outwardly opening casing of the annular carrier, (b) cavity means in the annular carrier adjacent a radially inner surface thereof, (c) aperture means in the annular carrier for providing communication between the distribution chamber means and said cavity means, and (d) exhaust duct means for exhausting the fluid from said cavity means, said exhaust duct means comprising an opening in said turbine casing, and annular collection chamber in said turbine casing and communicating said annular collection chamber with said cavity means.

2. A turbine ring according to claim 1, further comprising:

two radial, annular, flange member which are mutually axially spaced and fixed to the inner wall of the turbine casing, the annular carrier being axially held between the flange members with an interference fit, and means for immobilizing the annular carrier between the flange members in the circumferential direction of said annular carrier, whereby radial centering of the carrier with respect to a remainder of said turbine is maintained irrespective of expansion or contraction of said annular carrier during operation.

3. As turbine ring according to claim 2, wherein the immobilizing means comprise pegs, and means defining slots which receive the pegs when the annular carries is mounted between the flange members.

4. A turbine ring according to claim 1, including a plurality of axially spaced and annular recesses adjacent an interface of said annular carrier with said ceramic ring, adjacent ones of said recesses being connected by axially-extending grooves, passages formed in an axially up-stream end portion of said annular carrier for the supply of cooling fluid of said annular recesses and at least one passage in an axially down-stream end portion of said annular carrier for the exhaust of the cooling fluid from said annular recesses, the turbine ring further comprising a thin annular member positioned between said annular carrier and said ceramic ring and closing said annular recesses and axially extending grooves.

5. The turbine according to claim 1, wherein said means for applying said compression force comprise substantially axially extending mutual contact surfces of said annular carrier and said ceramic ring, said mutual contact surfaces being sized, when cold, such that said contact surface of said annular carrier has a diameter smaller than that of said ceramic ring contact surface by an amount sufficient that said annular carrier contact surface diameter is smaller than said ceramic ring contact surface diameter at all operating temperatures of said turbine.

6. The turbine according to claim 5, wherein said means for applying said compression force comprise substantially axially extending mutual contact surfaces of said annular carrier and said ceramic ring, said mutual contact surfaces being sized, when cold, such that said contact surface of said annular carrier has a diameter smaller than that of said ceramic ring contact surface by an amount sufficient that said annular carrier contact surface diameter is smaller than said ceramic ring contact surface diameter at all operating temperatures of said turbine.

7. The turbine according to claim 6, wherein said contact surface of said annular ring comprises radially inner surfaces of said projections.

* * * * *

UNITED STATES PATENT AND TRADEMARK OFFICE

CERTIFICATE OF CORRECTION

PATENT NO. : 4,679,981

DATED : JULY 14, 1987

INVENTOR(S) : ALAIN J.E. GUIBERT and ROLAND R. MESTRE and REMY P.C. RITT

It is certified that error appears in the above-identified patent and that said Letters Patent is hereby corrected as shown below:

In column 1, line 53, after "it" insert --provides--;

In column 3, line 20, after "carrier" insert --,--;

In column 3, line 40, after "rotor" insert --,--;

In column 3, line 65, delete "temperature" and insert --temperatures--;

In column 4, line 1, delete "Ther" and insert --The--;

In column 4, line 16, delete "is" and insert --are--;

In column 4, line 39, delete "tion" and insert --tional--;

In column 6, line 20, delete "transitories," and insert --transitories--;

In column 6, line 26, "of", second occurrence to read -- for --.

In column 6, line 34, delete "regions" and insert --region--;

In column 6, line 35, delete "pegs of" and insert --pegs or--;

In column 7, line 29, delete "suppying" and insert --supplying--;

UNITED STATES PATENT AND TRADEMARK OFFICE

CERTIFICATE OF CORRECTION

PATENT NO. : 4,679,981

DATED : JULY 14, 1987

INVENTOR(S) : ALAIN J.E. GUIBERT and ROLAND R. MESTRE and REMY P.C. RITT

It is certified that error appears in the above-identified patent and that said Letters Patent is hereby corrected as shown below:

In column 7, line 44, after "communicating" insert --with said opening, and radial ducts connecting--;

In column 7, line 48, delete "member" and insert --members--;

In column 8, line 12, delete "carries" and insert --carrier--;

In column 8, line 20, change "fluid of said" to --fluid to said--;

In column 8, line 29, delete "surfces" and insert --surfaces" --surfaces--;

In column 8, line 38, change "5" to --1--.

Signed and Sealed this

Twenty-sixth Day of April, 1988

*Attest:*

*Attesting Officer*

DONALD J. QUIGG

*Commissioner of Patents and Trademarks*